United States Patent [19]

Longo

[11] 4,304,437

[45] Dec. 8, 1981

[54] ADJUSTABLE CHAIR SUSPENDED FROM A SINGLE POINT

[76] Inventor: Michael C. Longo, P.O. Box 2966, Santa Cruz, Calif. 95062

[21] Appl. No.: 51,052

[22] Filed: Jun. 22, 1979

[51] Int. Cl.[3] ..... A63G 9/12; A47C 1/00

[52] U.S. Cl. ..... 297/277; 272/85; 297/278

[58] Field of Search ..... 5/124, 125, 127; 297/273, 277, 278; 272/85, 86, 87, 88, 89

[56] References Cited

U.S. PATENT DOCUMENTS

| | | | |
|---|---|---|---|
| 285,665 | 9/1883 | Peck | 297/278 |
| 296,775 | 4/1884 | Peck | 297/278 |
| 303,551 | 8/1884 | Arnold | 272/88 X |
| 424,329 | 3/1890 | Messmore | 297/278 |
| 461,541 | 10/1891 | Bunker | 272/86 |
| 3,256,016 | 6/1966 | Berlin | 272/85 |
| 3,420,522 | 1/1969 | Elliott | 272/85 |
| 3,528,657 | 9/1970 | Krupsky | 272/85 |
| 3,734,494 | 5/1973 | Sellner | 272/85 |
| 3,806,117 | 4/1974 | Foster | 272/86 |

FOREIGN PATENT DOCUMENTS

| | | | |
|---|---|---|---|
| 2220926 | 11/1975 | Fed. Rep. of Germany | 272/85 |

*Primary Examiner*—James T. McCall
*Attorney, Agent, or Firm*—Robert G. Slick

[57] ABSTRACT

A zero gravity chair is provided wherein a person is supported in an extremely comfortable manner. The chair utilizes only a single suspension point and a novel feature of the invention is that it is readily adjustable to accommodate individual preferences.

2 Claims, 4 Drawing Figures

ADJUSTABLE CHAIR SUSPENDED FROM A SINGLE POINT

SUMMARY OF THE INVENTION

The present invention relates to a chair or swing which is suspended from a single point with a suitable means such as a rope.

The chair of the present invention supports the body in a very comfortable manner.

In accordance with the invention, an easily adjustable feature is provided whereby the chair can be adjusted with respect to the angle at which the back is held with respect to the ground. In addition, the angle between the bottom or seat portion of the chair and the back portion of the chair can also be adjusted.

All of these adjustments are made in a very simple manner by means of ropes whereby a very inexpensive structure is provided.

Various other features and objects of the invention will be brought out in the balance of the specification.

DESCRIPTION OF THE PREFERRED EMBODIMENTS

Figure 1:
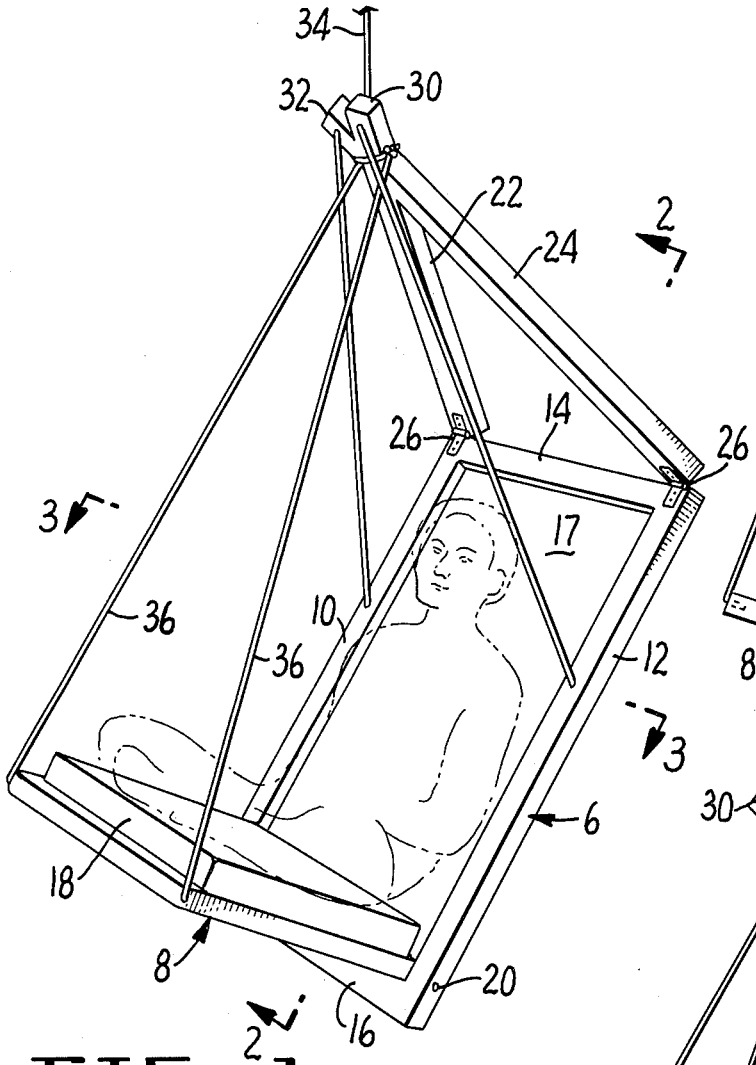
FIG. 1 is a perspective view of a chair embodying the present invention.
Figure 2:
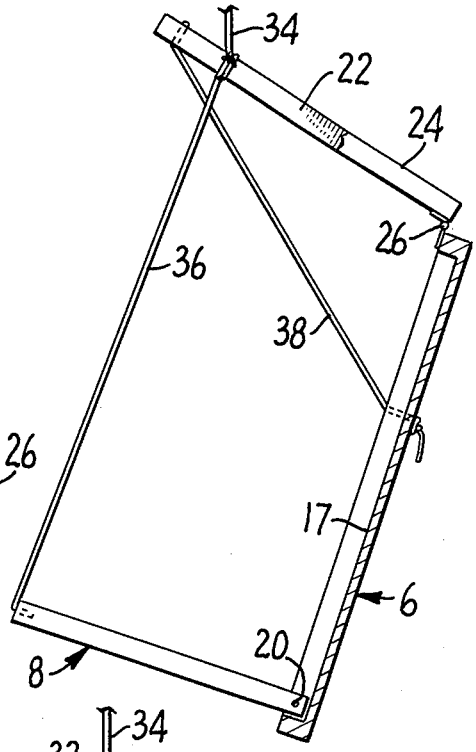
FIG. 2 is a section on the line 2—2 of FIG. 1.
Figure 3:
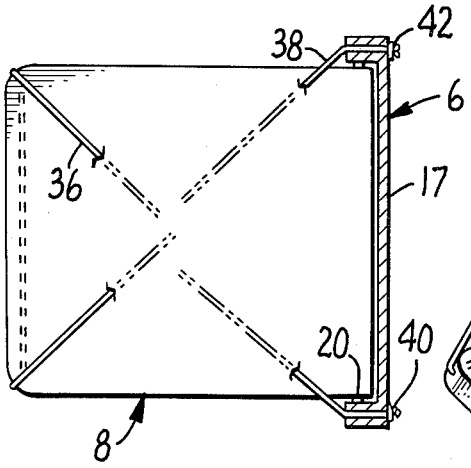
FIG. 3 is a section on the line 3—3 of FIG. 1.
Figure 4:
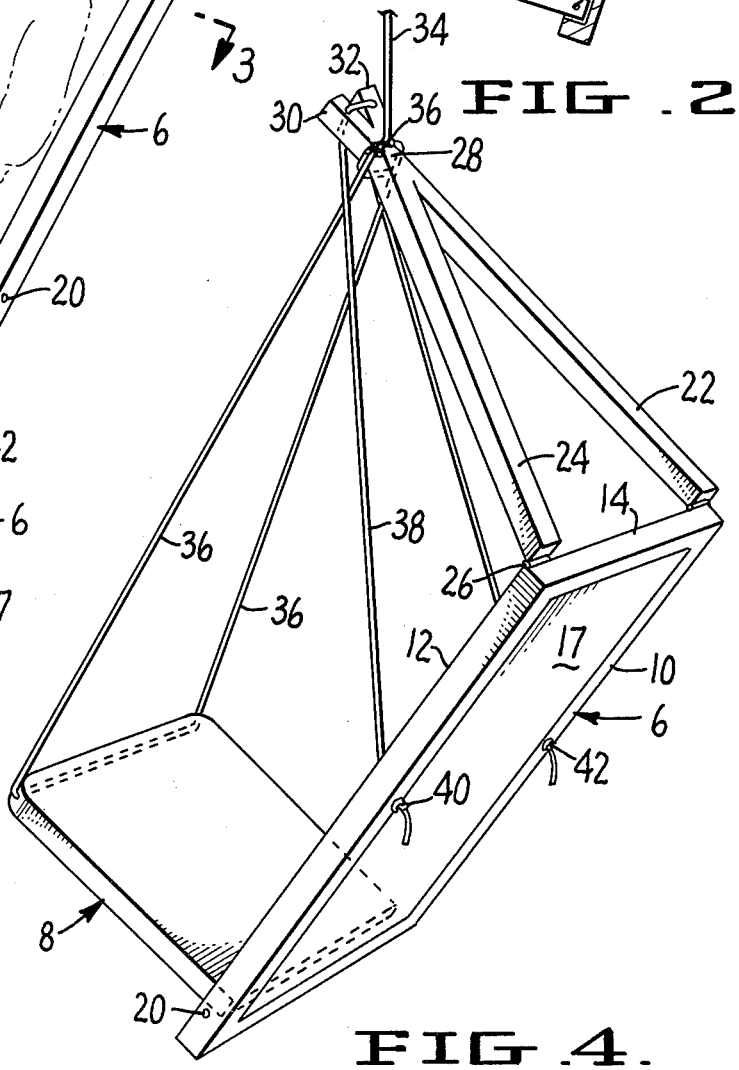
FIG. 4 is a rear perspective view of the chair.

Referring now to the drawings by reference characters, there is shown a chair having a back generally designated 6 and a bottom generally designated 8. The back 6 can be conveniently made utilizing a rectangular frame having the side members 10 and 12, top member 14 and bottom member 16, the frame supporting a fabric back 17. The bottom 8 can be similarly constructed or, in the embodiment shown, can be made of a solid wooden member. Preferably the bottom is provided with a cushion 18. It will be noted that the bottom of the chair 8 is mounted on pivots 20 so that the angle between the back 6 and the bottom 8 can be varied.

At the top of the chair are the two angular support members 22 and 24 forming an "A" frame with the bottoms of the legs mounted at the tops of the side members 10 and 12 respectively. The members 22 and 24 can pivot with respect to the back of the chair and, in the embodiment shown, this is provided by ordinary hinges 26. Obviously, other pivot means could be employed. The members 22 and 24 cross at point 28 and extend outwardly as shown at 30 and 32. A rope 34 is attached to the crossing point 28 and serves to support the chair. A rope 36 is attached to the front of the bottom of the chair and passes over the crossing point 36 of the members 22 and 24 and supports the bottom of the chair. The angle can be varied by adjusting the length of the rope.

A second rope 38 is attached near the center of the back member 12, extends upwardly where it goes through a hole in the extension 30, then to a hole in the extension 32 and back to the opposite side of the back, i.e. near the center of member 10. Rope 38 is attached to the back in such a manner that the length can easily be adjusted. In the embodiment shown, this can take the form of the simple knots 40 and 42 so that the angle between the members 22 and 24 with the back 6 can be easily adjusted. Of course, there will be some interaction between the ropes 36 and 38 so that the adjustment of the rope 38, which will control the angle at which the back 6 makes with the ground, will, to some extent, interact with the adjustment of the ropes 36 which basically determines the angle between the seat 8 and the back 6.

It is believed apparent that the chair of the present invention is easily adjusted to suit any user. Thus the angle which the back makes with the ground can be adjusted for greatest comfort. Also the angle that the bottom of the chair makes to the back can be adjustable if this is desired. Thus any user can adjust the chair to his particular preference without difficulty.

Many variations can be made in the exact structure shown without departing from the spirit of this invention. Although ropes are shown as the means for supporting the back and the seat as well as for the suspension of the chair, other wellknown support means can be substituted. Also, instead of using the pivot 20 and the hinges 26 one can use other pivoting means for allowing the angle of the chair to be adjusted.

The chair is illustrated as being made from squared lumber and, in many instances, a more artistic design would be preferred utilizing real or simulated tree limbs for a more natural look.

I claim:

1. An adjustable chair suspended from a single point comprising in combination:

a. a generally rectangular back having side members, b. a seat member pivotally connected to said back member c. a support member comprising a generally A-shaped frame with the bottom legs of the A pivotally mounted with the top edges of the back member, d. a single support member extending upwardly from the vertex of the A-shaped frame, e. a first flexible member connecting said vertex to the bottom of said seat member, f. a second flexible member connecting said vertex to points at approximately the centers of said side members, and said second flexible member being adjustable whereby the angle which said back makes wit the horizon can be varied.

2. The structure of claim 1 wherein the length of said first flexible member is adjustable whereby the angle between the back member and the seat member is adjustable.

* * * * *